US009565947B2

(12) United States Patent
Oblak et al.

(10) Patent No.: US 9,565,947 B2
(45) Date of Patent: Feb. 14, 2017

(54) STANDING-UP TRAINER

(71) Applicant: medica Medizintechnik GmbH, Hochdorf (DE)

(72) Inventors: Jakob Oblak, Straza (SI); Zlatko Matjacic, Ljubljana (SI)

(73) Assignee: medica-Medizintechnik GmbH, Hochdorf (DE)

( * ) Notice: Subject to any disclaimer, the term of this patent is extended or adjusted under 35 U.S.C. 154(b) by 41 days.

(21) Appl. No.: 14/500,209

(22) Filed: Sep. 29, 2014

(65) Prior Publication Data

US 2015/0018177 A1 Jan. 15, 2015

Related U.S. Application Data

(63) Continuation of application No. PCT/DE2013/100072, filed on Feb. 25, 2013.

(30) Foreign Application Priority Data

Mar. 29, 2012 (DE) ..... 10 2012 102 699

(51) Int. Cl.

| | |
|---|---|
| ***A47C 1/00*** | (2006.01) |
| ***A47C 9/00*** | (2006.01) |
| ***A61G 5/14*** | (2006.01) |
| ***A63B 21/068*** | (2006.01) |
| ***A63B 22/20*** | (2006.01) |
| ***A63B 23/04*** | (2006.01) |

(Continued)

(52) U.S. Cl.

CPC ..... *A47C 9/002* (2013.01); *A61G 5/14* (2013.01); *A63B 21/00181* (2013.01); *A63B 21/068* (2013.01); *A63B 22/20* (2013.01); *A63B 23/0405* (2013.01); *A63B 2022/0092* (2013.01); *A63B 2022/0094* (2013.01); *A63B 2208/0204* (2013.01); *A63B 2208/0233* (2013.01)

(58) Field of Classification Search

CPC ..... A61G 5/14
USPC ..... 297/330, DIG. 10, 285, 296, 297
See application file for complete search history.

(56) References Cited

U.S. PATENT DOCUMENTS 4,120,530 A * 10/1978 Imbro ..... A61G 5/14 297/115
4,637,652 A * 1/1987 Bergenwall ..... A47C 1/035 297/330

(Continued)

FOREIGN PATENT DOCUMENTS

DE 20 2009 013 889 U1 5/2010
EP 1 275 363 A2 1/2003

(Continued)

OTHER PUBLICATIONS

Chinese Office Action for Chinese Application No. 201380017116.X dated Mar. 16, 2016 with English translation.

*Primary Examiner* — David R Dunn
*Assistant Examiner* — Alexander Harrison
(74) *Attorney, Agent, or Firm* — Muncy, Geissler, Olds & Lowe, P.C.

(57) ABSTRACT

A standing-up trainer, in particular for use in rehabilitation for mobilizing persons having limited mobility. In order to adjust a seat base between a sitting position and a standing position, a positioning unit that is adjustable by a drive is provided, and at least one securing device for securing the convalescent is provided.

17 Claims, 4 Drawing Sheets

(51) Int. Cl.
*A63B 21/00* (2006.01)
*A63B 22/00* (2006.01)

(56) References Cited

U.S. PATENT DOCUMENTS 4,809,804 A * 3/1989 Houston ..... A61G 5/14 180/65.51
4,869,552 A * 9/1989 Tolleson ..... A47C 7/445 248/160
4,890,853 A 1/1990 Olson
4,925,228 A * 5/1990 Pipon ..... B60N 2/10 248/395
5,061,010 A * 10/1991 LaPointe ..... A61G 5/14 297/325
5,137,102 A * 8/1992 Houston, Sr. ..... A61G 5/042 180/65.51
5,165,753 A * 11/1992 Henderson ..... A61G 5/14 297/326
5,265,935 A * 11/1993 Geisler ..... A61G 5/14 297/325
5,346,280 A * 9/1994 Deumite ..... A61G 5/14 180/907
5,984,338 A * 11/1999 Meyer ..... A61G 5/14 280/304.1
6,125,957 A * 10/2000 Kauffmann ..... A61G 5/14 180/65.1
6,142,568 A * 11/2000 Abelbeck ..... A61G 5/1059 297/330
6,213,554 B1 * 4/2001 Marcoux ..... A61G 5/14 297/330
6,250,717 B1 * 6/2001 Porcheron ..... A61G 5/12 297/411.3
6,440,046 B1 8/2002 Tholkes
6,659,556 B2 * 12/2003 Pellerin ..... A61G 5/14 297/330
6,672,668 B1 * 1/2004 Boruta ..... A61G 15/005 297/316
6,783,179 B2 * 8/2004 Komura ..... A61G 5/14 297/330
7,097,189 B2 * 8/2006 Hsu ..... A61G 5/14 280/250.1
7,455,360 B2 * 11/2008 White ..... A47C 1/029 297/321
7,601,104 B2 10/2009 Agrawal et al.
7,735,926 B1 * 6/2010 Combs ..... A61G 5/14 297/337
8,973,997 B2 * 3/2015 Green ..... A61G 5/1067 297/284.11
2003/0038518 A1 * 2/2003 Williams ..... A61G 5/14 297/330
2004/0160103 A1 * 8/2004 Aono ..... A61G 5/006 297/330
2004/0189071 A1 9/2004 Komura et al.
2005/0227826 A1 10/2005 Oga
2006/0076813 A1 * 4/2006 Mohn ..... A61G 5/14 297/330
2006/0238007 A1 * 10/2006 Lin ..... A61G 5/14 297/330
2012/0181832 A1 * 7/2012 Lin ..... A61G 5/14 297/330

FOREIGN PATENT DOCUMENTS

EP 1 716 834 A2 11/2006
WO WO 88/01578 A1 3/1988
WO WO 03/041628 A2 5/2003
WO WO 2004/098479 A1 11/2004

* cited by examiner

STANDING-UP TRAINER

This nonprovisional application is a continuation of International Application No. PCT/DE2013/100072, which was filed on Feb. 25, 2013, and which claims priority to German Patent Application No. DE 10 2012 102 699.8, which was filed in Germany on Mar. 29, 2012, and which are both herein incorporated by reference.

BACKGROUND OF THE INVENTION

Field of the Invention

The present invention relates to a standing-up, for example, sit-to-stand, trainer, particularly for mobilizing convalescents with limited mobility in the rehabilitation sector, whereby to move a seat base between a sitting position and a standing position, a positioning unit movable by a drive is provided and at least one securing device for securing the convalescent is provided.

Description of the Background Art

Convalescents, who have limited mobility due to illness, for example, stroke patients, are often confronted with the problem that they must relearn motion sequences necessary for daily life. In particular, the coordination of movements that are associated with a shifting of the body's center of gravity often poses great problems for these convalescents. Thus, for example, they must relearn how to stand up and sit down. This motion sequence makes high demands on coordination abilities. Thus, when standing up, the shoulders must first be shifted forwards in the direction of the toes. The center of gravity is then shifted further forwards in that the lower legs are tilted over the ankle joint, as a result of which the knees are also shifted forwards. This then results in a slight lifting of the thighs and buttocks from the seat base. The convalescent is then brought into the standing position by extending the legs and a simultaneous movement back of the shoulder section and thereby also of the center of gravity. With these shifts in the center of gravity, there is always the risk, however, that the center of gravity is shifted too far, which leads to a considerably increased risk of falling. There is the problem, moreover, that the muscle strength of the convalescents is often not sufficient to be able to perform the motion sequence independently.

For this reason, when the standing up process is being relearned, a supervising attendant must always be present, who supports the convalescent and takes him actively from the sitting position to the standing position. The associated effort has the result that the reintegration of these convalescents into daily life is highly care-intensive and thereby also very cost-intensive. In other respects, these exercises are physically very strenuous not only for convalescents, but also for the assistants, particularly if the assistant is much lighter in weight.

DE 20 2009 013 889 U1 discloses an adjustment device, in which by means of a electromotive adjustment, which is realized by a spindle drive, a seat base can be taken from a horizontal position to a vertical position. However, the use of such a device is associated with the problem that a spindle drive often cannot stand up to stress, particularly in the case of overweight patients, as a result of which the lifetime of the device is appreciably shortened. In addition, there is no guidance for the positioning unit, which has a negative effect on the stability of the adjustment device.

Furthermore, EP 1 716 834, which corresponds to U.S. Pat. No. 7,601,104, discloses a sit-to-stand device in which the standing up motion is supported by a counterweight. A drive and a seat base are omitted, however, so that a forced movement is not possible. Furthermore, the user must be awkwardly attached to the device because of the lack of a seat base.

U.S. Pat. No. 6,440,046 B1 discloses a training device for disabled persons, particularly for wheelchair users. In this case, a seat base is taken from a horizontal position to a vertical standing position by means of an air spring adjustable with a lever. A motorized adjustment of the seat base is not provided, however. Furthermore, the sit-to-stand training of the user is not the main focus here. Rather, the standing position is used to enable the user to perform a positively controlled walking motion of the legs, which is initiated via handles by a movement of the arms, similar to a cross trainer.

SUMMARY OF THE INVENTION

It is therefore an object of the present invention to reduce the above-mentioned disadvantages in a sit-to-stand trainer of the aforementioned type.

The object is achieved according to an embodiment of the invention with a sit-to-stand trainer of the aforementioned type in that a support strut for guiding the positioning unit is provided, whereby the positioning unit is formed by a carriage surrounding the support strut. An assistant can essentially be dispensed with because of the use of a positioning unit, which is adjustable by a drive. This has positive effect on the financial expenditures. Thus, the convalescent can be seated, for example, by an assistant in the sit-to-stand trainer and then complete the exercises on his own without the assistant's help. This means in particular that an assistant can care simultaneously for a number of convalescents, which particularly at larger rehabilitation facilities has a positive effect on the cost situation. It is also provided within the scope of the invention that the force of the drive can be adjusted and thereby adapted to the requirements of the particular convalescent. Thus, it is reasonable that depending on the severity of the illness, the force of the drive can be varied between slight support and a complete drive-controlled shifting of the convalescent between the sitting position and the standing position. Moreover, it is also provided within the scope of the invention that the starting and ending position of the positioning unit can be set, as a result of which the sit-to-stand trainer can be adapted to the mobility of the convalescent. The use of the at least one securing device for securing the convalescent assures that he is secured during the use of the sit-to-stand trainer of the invention and that an assistant can be essentially dispensed with. As a result, the convalescent is given an additional feeling of security and falling is effectively prevented. This also has the critical advantage that a number of sit-to-stand trainers can be attended to by only one assistant. The assistant can thus provide the particular convalescent with a one-time assistance in entering the sit-to-stand trainer, secure him in the sit-to-stand trainer, and then allow him to train alone without the assistant being at risk of neglecting his responsibilities. In addition, the sit-to-stand trainer can also be used by convalescents with only very limited control over their motor abilities. This refers, for example, to convalescents with spasticity or the like. The use of the support strut confers stability on the sit-to-stand trainer of the invention and moreover the position of the positioning unit can be set thereby. It is also provided within the scope of the invention that the positioning unit is realized hydraulically or pneumatically, as a result of which the guidance function of the support strut can be omitted. The position of the connected seat base is always set by the use of a carriage guided on the support strut.

The at least one securing device for securing the convalescent can be designed as a belt and/or a knee brace. The use of a belt, which within the scope of the invention can be attached to the seat base, holds the pelvic region of the convalescent and this effectively prevents the convalescent from falling out of the sit-to-stand trainer of the invention during its use. Moreover, it is also provided within the scope of the invention that in addition to or instead of the belt, a knee brace is attached to the sit-to-stand trainer that is used to support and guide the knee region of the convalescent when standing up.

The seat base can be connected to the positioning unit via a seat strut mounted rotatably on the positioning unit and not oriented parallel to the support strut. The lack of parallelism between the support strut and the seat strut assures that movement of the positioning unit along the support strut always induces a torque, which is used for moving the seat base. It is also provided within the scope of the invention that the support strut can be designed like a control cam that presets the trajectory of the seat base directly attached thereto.

A wheel rolling on the support strut can be provided for guidance support for the positioning unit on the support strut. This has a positive effect on the operational safety of the sit-to-stand trainer.

A knee lever directly or indirectly connecting the backrest with the support strut can be provided for the positively driven movement of a backrest, a movement that is derived from the motion of the seat base. This assures that the backrest is moved simultaneously with the seat base. The desired trajectory of the backrest can also be specifically defined, moreover, by the shape of the knee lever with the selected leg length. It is also provided within the scope of the invention that the backrest is likewise provided with a securing device for securing the convalescent. This assures that the position of the upper body of the convalescent is firmly determined during use of the sit-to-stand trainer of the invention, which reduces the risk of falling.

In an embodiment, a chassis is provided for holding a frame comprising two support struts inclined from the vertical and connected together by a horizontal auxiliary strut. The vertically inclined arrangement of the support struts when the positioning unit moves along the support strut inclined toward the seat strut causes a superposition of translation and rotation, which results in a tilting and raising of the seat base. It is naturally also conceivable within the scope of the invention that the support strut is attached vertically and the seat strut not vertically. It is also possible, moreover, that both the seat strut and the support strut are not oriented vertically. In addition, the chassis also provides a mount for the drive and it is assured by the frame that the sit-to-stand trainer of the invention provides sufficient stability also when used by overweight persons.

The seat base can be connected to the chassis by a leg strut. As a result, the seat base is additionally supported, which has a positive effect on the reliability of the sit-to-stand trainer. If a knee brace is provided as a securing device for securing the convalescent in a sit-to-stand trainer of the invention, then said brace can be mounted on the leg strut, as a result of which the knee region of the convalescent is effectively supported during use of the sit-to-stand trainer of the invention.

The chassis can be connected to the leg strut for tilting the seat base via a tilting element. This assures that the knees of the user can be shifted forward when standing up, which promotes the support of the natural motion sequence. The tipping element in this case can be formed in the customary manner as a joint or as an elastically deformable part.

The seat base can be connected to the leg strut for moving the seat base between the sitting position and the standing position via an uprighting joint. As a result, during the movement of the positioning unit, the seat base is moved between a substantially horizontal sitting position and a substantially vertical standing position.

The backrest can be provided with at least one spring return element to support the natural physiological motion sequence, by which the back of the convalescent is also given certain degrees of freedom.

For the versatile use of the sit-to-stand trainer, the chassis can be provided with rollers that are preferably steerable and/or lockable. As a result, the position of the entire sit-to-stand trainer can be changed in a simple way. The lockability of the rollers also assures that the sit-to-stand trainer is always stable during use. Due to the use of rollers, the sit-to-stand trainer can also be used in the home, because when not in use it can be easily moved away.

The chassis can be provided with a preferably height-adjustable footrest for propping up the soles of a user's feet. In this way, the sit-to-stand trainer can be adjusted individually to the size proportions of the particular convalescent and provides him with a secure platform for motion sequence training.

The force transmission of the drive to the positioning unit can be realized by deflection rollers. This assures that the drive must always exert only a tractive force independent of the position of the positioning unit. This is of great advantage for the durability of the drive, as a result which service and maintenance costs are also reduced over the long term.

The drive can be realized by a motor, particularly by an electric motor. Because such an electric motor is emission-free and moreover runs very quietly, the use of such an electric motor has a positive effect on the user-friendliness and usability of the sit-to-stand trainer of the invention in interior spaces.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
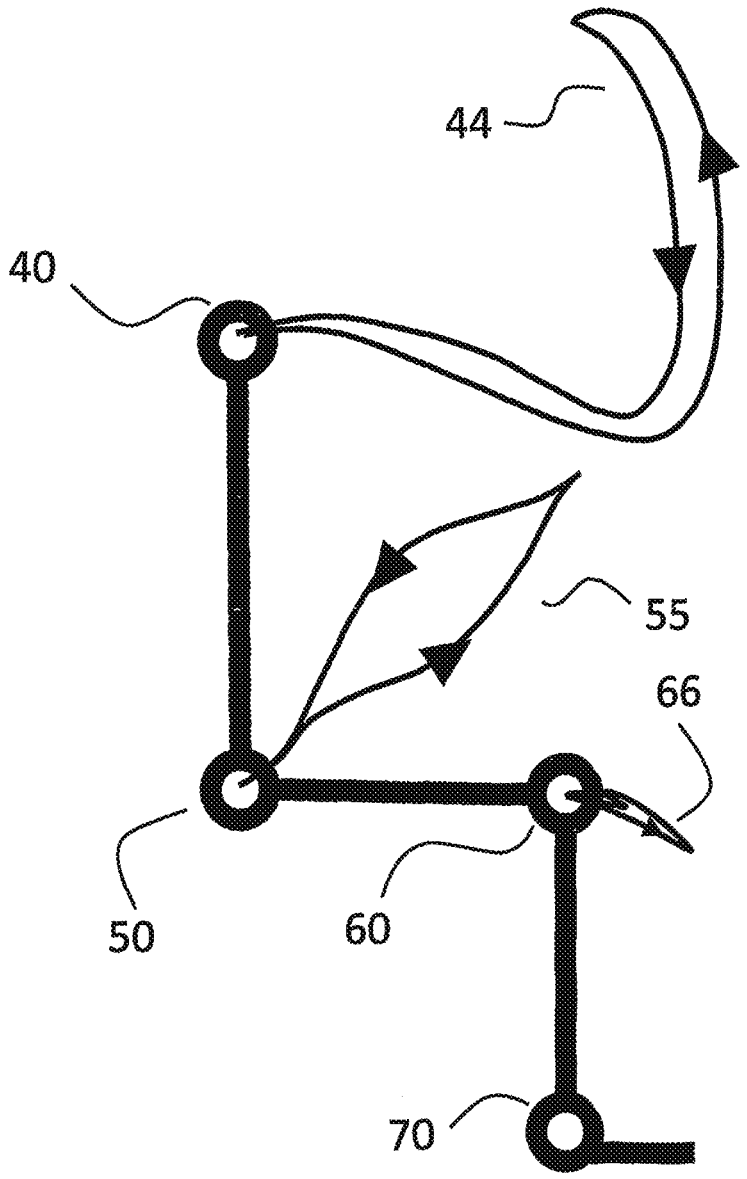
FIG. 1 shows a schematic illustration of a person in a sitting position with an illustration of the trajectories forming when standing up and sitting down.
Figure 2:
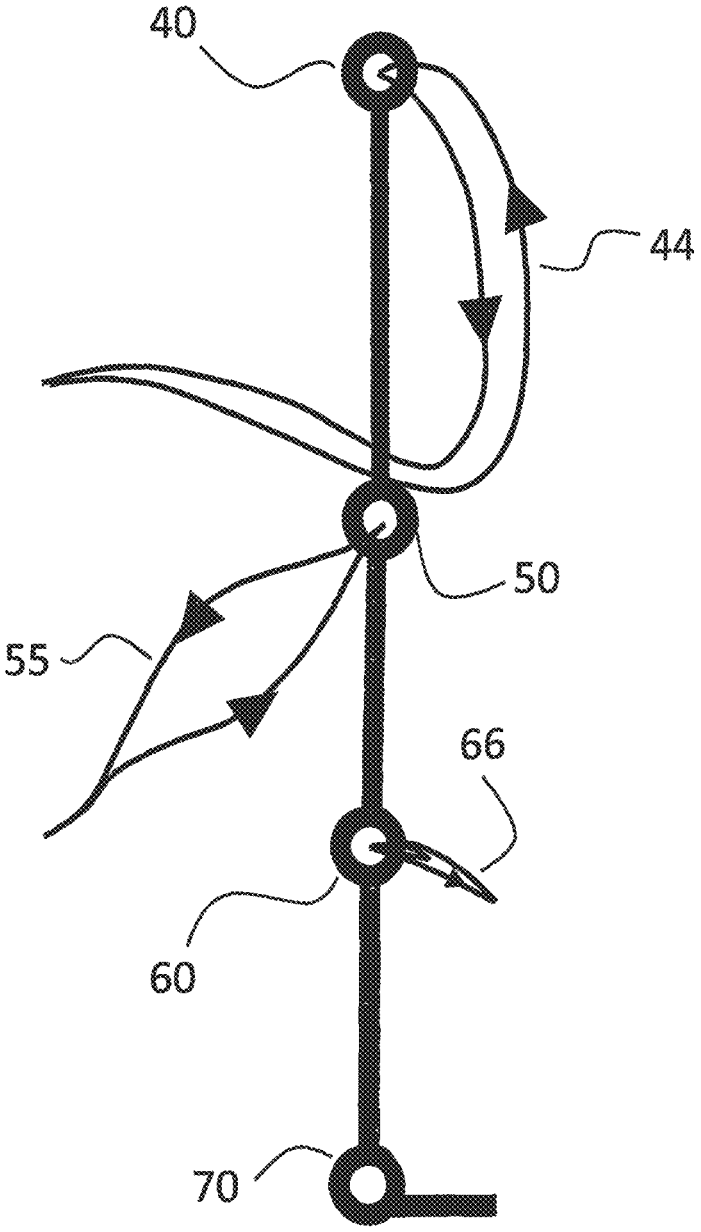
FIG. 2 shows a schematic illustration of a person in a standing position with an illustration of the trajectories forming when standing up and sitting down.

FIGS. 1 and 2 in schematic illustrations show the trajectories of individual body parts, which arise when a person, for example, a convalescent, stands up and sits down. FIG. 1 here shows the person in a sitting position and the person is shown standing in FIG. 2. In this case, the trajectories of a shoulder region 40, a hip region 50, a knee region 60, and an ankle region 70 are shown. During a natural movement from the sitting position, which is shown in FIG. 1, to the standing position, shown in FIG. 2, shoulder region 40 is first shifted forwards. As is evident from a shoulder trajectory 44, the shoulder region here is also inclined slightly downward in addition. At the same time, knee region 60 according to a knee trajectory 66 likewise tilts obliquely forward and downward in the direction of the soles. This results in a shifting forward of the body's center of gravity, as a result of which hip region 50 is relieved and can now be moved along a hip trajectory 55 obliquely forward and upward. Shoulder region 40 is now straightened up along shoulder trajectory 44 and knee region 60 is again moved back, so that in the standing position there is a substantially vertical orientation of the person's shoulder region 40, hip region 50, knee region 60, and ankle region 70. During the shifting from the standing position back to the sitting position, hip region 50 is essentially first moved obliquely downward, as a result of which shoulder region 40 initially is also lowered. As is evident from knee trajectory 66, knee region 60 inclines only slightly during the sitting down movement and otherwise remains stationary. FIGS. 1 and 2 show that hip trajectory 55 and especially shoulder trajectory 44 exhibit a considerable hysteresis behavior. Thus, during the sitting down movement hip region 50 remains upright longer and is moved downward only later in the direction of the seat base. Only ankle region 70 remains stationary during the entire motion sequence.

Figure 3:
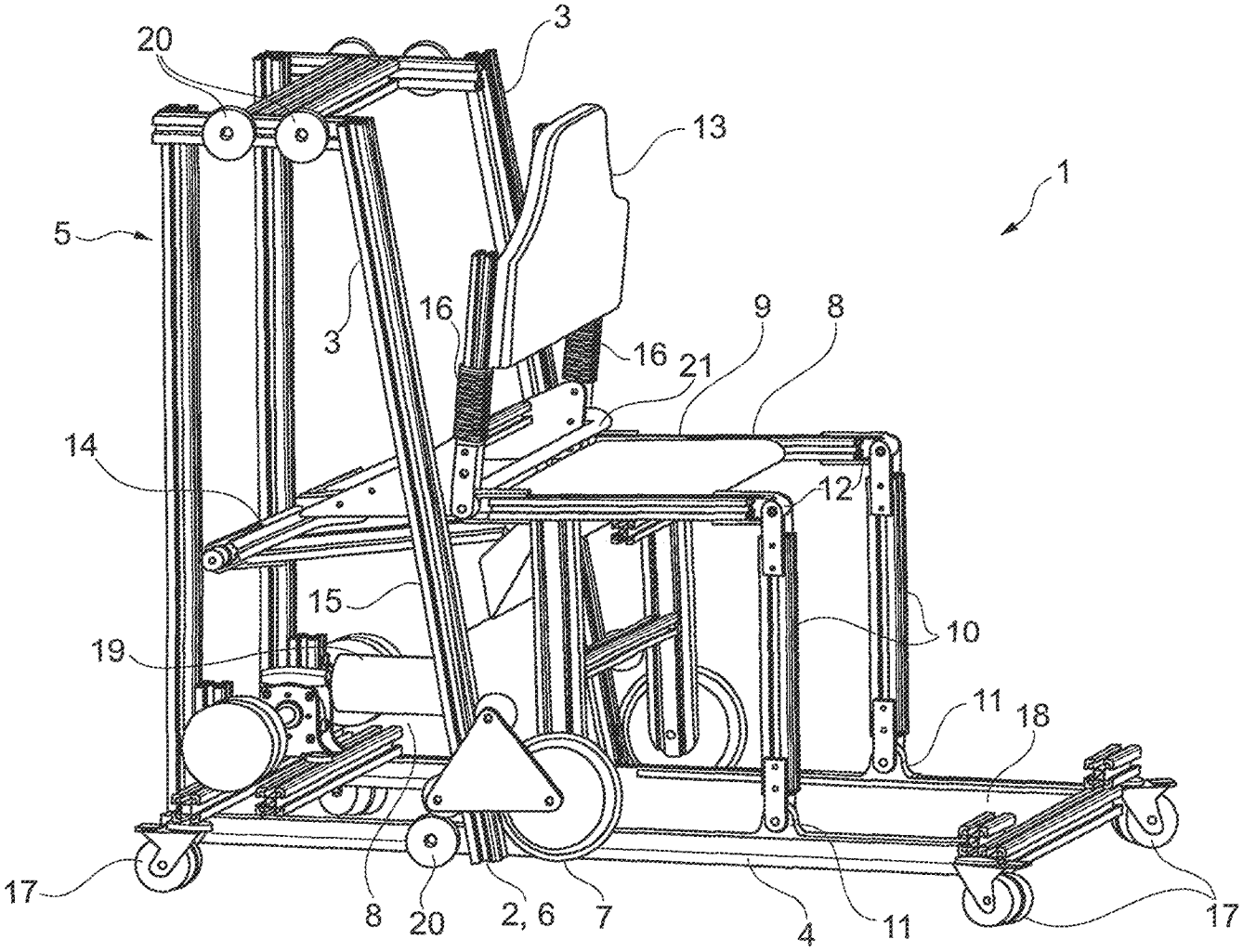
FIG. 3 shows a perspective view of a sit-to-stand trainer.

FIG. 3 shows a sit-to-stand trainer 1 of the invention, which is used to support a convalescent in the training of the natural motion sequence required for standing up and sitting down and to allow or to enable the trajectories shown in FIGS. 1 and 2. Two positioning units 2 can be seen that are guided on a support strut 3, which is part of a frame 5 attached to a chassis 4, and are formed by a carriage 6, which is guided in addition by a wheel 7 rolling on support strut 3. Positioning unit 2 is connected in each case via a seat strut 8, mounted rotatably on wheel 7, to a seat base 9. In order to bring about a movement of seat base 9 from a substantially horizontal sitting position to a substantially vertical standing position during the movement of positioning unit 2, it is necessary that support struts 3 are not arranged parallel to seat strut 8. In the shown exemplary embodiment, seat struts 8 hereby are arranged vertically and support struts 3 not vertically. Because the two struts are not parallel to one another, during a movement of positioning units 2 along support struts 3, seat base 9 is not only moved upward but is also uprighted. To increase the stability of sit-to-stand trainer 1 of the invention, seat base 9 is connected to chassis 4 via leg struts 10. To enable the shifting of the knees in the direction of the toes, the connection of leg struts 10 to chassis 4 is not rigid, but realized by tilting elements 11, which are designed as joints in the shown exemplary embodiment. The tipping makes it possible that during the movement of seat base 9 from the sitting position to the standing position, the knees are tilted according to the natural physiological motion sequence in the direction of the toes. In order to bring seat base 9 into an upright position during a movement of positioning unit 2, seat base 9 is connected to leg strut 10 via an uprighting joint 12. For the positively driven movement of a backrest 13 connected to seat base 9, a knee lever 14 is provided, which in the shown exemplary embodiment is attached to an auxiliary strut 15, horizontally connecting the two support struts 3, and backrest 13. To support the natural physiological motion sequence, backrest 13 is assigned a spring return element 16, which in the shown exemplary embodiment is made as a spiral spring. As a result, the natural physiological motion sequence is supported, because the convalescent can always move against the countering spring force. In the shown exemplary embodiment, chassis 4 has rollers 17 that are made steerable and lockable. Sit-to-stand trainer 1 can be easily moved by these, which also promotes the use in the home, because sit-to-stand trainer 1 can be just pushed into a corner when it is not being used. The user of sit-to-stand trainer 1 has the option of placing his feet on a footrest 18, associated with chassis 4. For better adaptation to the particular user, it is preferably adjustable in height. The force of a drive 19, made as an electric motor in the shown exemplary embodiment, is transmitted via deflection rollers 20 to the positioning unit. It is also provided within the scope of the invention that the force of drive 19 can be adjusted. As a result, the support by drive 19 can be adapted to the requirements and weight of the particular convalescent. Thus, in the case of a convalescent who experiences very great impairment of the motion sequence because of a transection of the spinal cord, the necessary force support is much greater than, for example, in a stroke patient who because of his illness suffers only from mild motor disturbances with a possible impairment of the sense of balance. Moreover, the starting and ending position of the positioning unit and thereby the seat base can also be set before the start of training and thereby be adapted to the requirements of the particular convalescent. A securing device 21 for securing the convalescent is also shown in the drawing. In the shown exemplary embodiment, securing device 21 is designed as a belt, which fixes the convalescent in the pelvic area and thereby secures him from falling out of sit-to-stand trainer 1.

Figure 4:
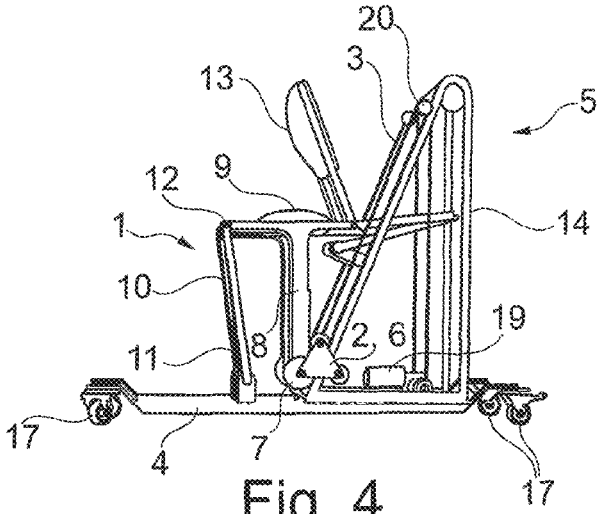
FIG. 4 shows a schematic illustration of the sit-to-stand trainer in the sitting position.
Figure 5:
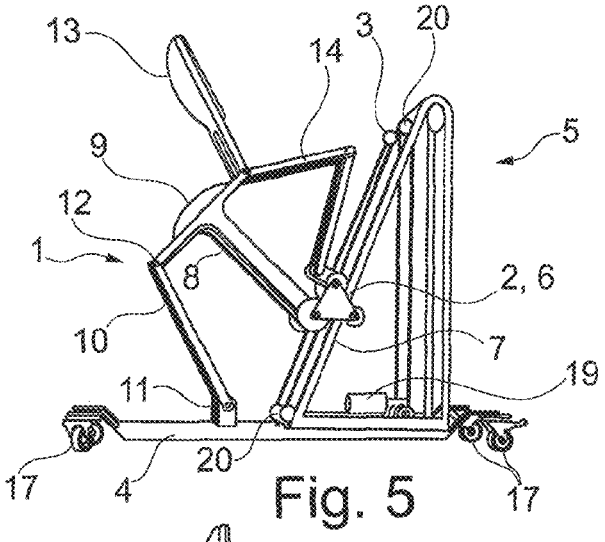
FIG. 5 shows a schematic illustration of the sit-to-stand trainer in an intermediate position.
Figure 6:
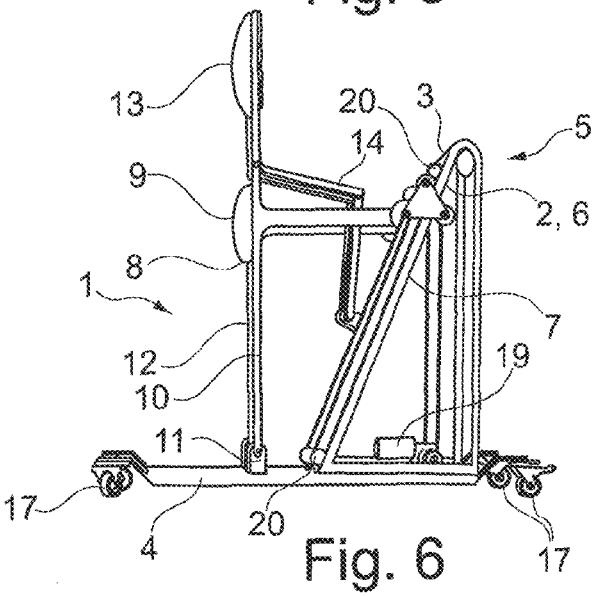
FIG. 6 shows a schematic illustration of the sit-to-stand trainer in the standing position.

FIGS. 4 to 6 show schematic illustrations of sit-to-stand trainer 1 of the invention in different positions. In FIG. 4 sit-to-stand trainer 1 is in the sitting position. In this case, seat base 9 is arranged substantially horizontally and backrest 13 in a substantially vertical position. Knee lever 14 is in a closed position here. If positioning units 2 are now moved along support struts 3, the situation shown below in FIG. 5 arises.

FIG. 5 shows an intermediate position between the sitting position and the standing position. In this case, by moving positioning units 2 and seat base 9 connected thereto, leg struts 10 are inclined forward via tilting elements 11. As a result, the user's knees shift in the direction of his toes. Simultaneously, seat base 9 is set upright by the movement of positioning units 2 and backrest 13 and thereby the shoulder region of a user is shifted forward by the opening up of knee lever 14. This has the result that the user's center of gravity is likewise shifted forwards.

In the standing position, which is shown in FIG. 6, backrest 13 now forms a substantially vertical plane with seat base 9 and leg struts 10. The knees of a user are fully extended, as a result of which the user comes to stand vertically. If now the running direction of motor 19 is changed, thus by moving positioning units 2, leg struts 11 are tilted forwards via tilting elements 11. As a result, seat base 9 pivots backward and the motion sequence ends again in the sitting position, which represented the starting position.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sit-to-stand trainer for mobilizing convalescents with limited mobility, the sit-to-stand trainer comprising:

a positioning unit adapted to move a seat base between a sitting position and a standing position, the positioning unit being movable by a drive;

at least one securing device for securing the convalescent; and a support strut for guiding the positioning unit, the support strut being oriented in a substantially vertical direction in both the sitting position and the standing position of the seat base, and a knee lever that directly or indirectly connects a backrest with the support strut for a positively driven movement of the backrest, the movement being derived from the motion of the seat base, wherein the positioning unit is formed by a carriage surrounding the support strut, and wherein the knee lever is positioned behind the support strut in a sitting position of the seat base and is positioned in front of the support strut in the standing position of the seat base.

2. The sit-to-stand trainer according to claim 1, wherein the at least one securing device for securing the convalescent is a belt and/or a knee brace.

3. The sit-to-stand trainer according to claim 1, wherein the seat base is connected to the positioning unit via a seat strut mounted rotatably on the positioning unit and not oriented parallel to the support strut.

4. The sit-to-stand trainer according to claim 1, wherein the positioning unit further comprises a wheel and wherein the wheel of the positioning unit rolls on the support strut for guidance support for the positioning unit on the support strut.

5. The sit-to-stand trainer according to claim 1, further comprising two of the support strut and a chassis for holding a frame comprising the two support struts that are connected together by a horizontal auxiliary strut.

6. The sit-to-stand trainer according to claim 5, wherein the seat base is connected to the chassis by a leg strut.

7. The sit-to-stand trainer according to claim 1, wherein the backrest is provided with at least one spring return element to support a natural physiological motion sequence.

8. The sit-to-stand trainer according to claim 5, wherein the chassis has rollers that are steerable and/or lockable.

9. The sit-to-stand trainer according to claim 5, wherein the chassis has a height-adjustable footrest to support soles of a user's feet.

10. The sit-to-stand trainer according to claim 1, wherein a force transmission of the drive to the positioning unit is realized by deflection rollers.

11. The sit-to-stand trainer according to claim 1, wherein the drive is a motor, particularly an electric motor.

12. The sit-to-stand trainer according to claim 1, wherein the knee lever includes at least two levers pivotably connected to each other.

13. The sit-to-stand trainer according to claim 1, further comprising two of the support strut and two of the positioning unit.

14. The sit-to-stand trainer according to claim 1, wherein the support strut remains stationary in both the sitting position and the standing position of the seat base.

15. A sit-to-stand trainer for mobilizing convalescents with limited mobility, the sit-to-stand trainer comprising:

a positioning unit adapted to move a seat base between a sitting position and a standing position, the positioning unit being movable by a drive;

at least one securing device for securing the convalescent;

two support struts for guiding the positioning unit, the support struts being oriented in a substantially vertical direction in both the sitting position and the standing position of the seat base, and a chassis for holding a frame comprising the two support struts that are connected together by a horizontal auxiliary strut, wherein the positioning unit is formed by a carriage surrounding the support struts, wherein the seat base is connected to the chassis by a leg strut, and wherein the chassis is connected to the leg strut for tilting the seat base via a tilting element.

16. A sit-to-stand trainer for mobilizing convalescents with limited mobility, the sit-to-stand trainer comprising:

a positioning unit adapted to move a seat base between a sitting position and a standing position, the positioning unit being movable by a drive;

at least one securing device for securing the convalescent;

two support struts for guiding the positioning unit, the support struts being oriented in a substantially vertical direction in both the sitting position and the standing position of the seat base, and a chassis for holding a frame comprising the two support struts that are connected together by a horizontal auxiliary strut, wherein the positioning unit is formed by a carriage surrounding the support struts, wherein the seat base is connected to the chassis by a leg strut, and wherein the seat base is connected to the leg strut for moving the seat base between the sitting position and the standing position via an uprighting joint.

17. A sit-to-stand trainer for mobilizing convalescents with limited mobility, the sit-to-stand trainer comprising:

a positioning unit adapted to move a seat base between a sitting position and a standing position, the positioning unit being movable by a drive;

at least one securing device for securing the convalescent;

two support struts for guiding the positioning unit, the support struts being oriented in a substantially vertical direction in both the sitting position and the standing position of the seat base, and a chassis for holding a frame comprising the two support struts that are connected together by a horizontal auxiliary strut, wherein the positioning unit is formed by a carriage surrounding the support struts, wherein the seat base is connected to the chassis by a leg strut, and wherein a first end of the leg strut is pivotably connected to the chassis and a second end of the leg strut is pivotably connected to the seat base.

* * * * *